US010462577B2

(12) United States Patent
Ralph

(10) Patent No.: US 10,462,577 B2
(45) Date of Patent: Oct. 29, 2019

(54) PORTED CAVITY TWEETER

(71) Applicant: Alexander B. Ralph, Winter Garden, FL (US)

(72) Inventor: Alexander B. Ralph, Winter Garden, FL (US)

( * ) Notice: Subject to any disclaimer, the term of this patent is extended or adjusted under 35 U.S.C. 154(b) by 0 days.

(21) Appl. No.: 16/250,309

(22) Filed: Jan. 17, 2019

(65) Prior Publication Data

US 2019/0253807 A1 Aug. 15, 2019

Related U.S. Application Data

(60) Provisional application No. 62/631,066, filed on Feb. 15, 2018.

(51) Int. Cl.

| | |
|---|---|
| ***H04R 9/06*** | (2006.01) |
| ***H04R 9/02*** | (2006.01) |
| ***H04R 7/12*** | (2006.01) |
| ***H04R 7/18*** | (2006.01) |
| ***H04R 9/04*** | (2006.01) |

(52) U.S. Cl.

CPC ..... *H04R 9/06* (2013.01); *H04R 7/127* (2013.01); *H04R 7/18* (2013.01); *H04R 9/025* (2013.01); *H04R 9/04* (2013.01)

(58) Field of Classification Search

CPC . H04R 9/06; H04R 9/025; H04R 9/04; H04R 7/127; H04R 7/18; H04R 7/12; H04R 7/16

USPC ..... 381/396–433

See application file for complete search history.

(56) References Cited

U.S. PATENT DOCUMENTS

| | | | | |
|---|---|---|---|---|
| 4,190,746 | A | 2/1980 | Harwood et al. | |
| 4,351,412 | A | 9/1982 | Yamamuro et al. | |
| 4,443,667 | A * | 4/1984 | Hunt | H04R 11/00 335/235 |
| 4,817,165 | A | 3/1989 | Amalaha | |
| 4,953,655 | A | 9/1990 | Furukawa | |
| 5,010,977 | A * | 4/1991 | Furukawa | G10K 11/04 181/150 |
| 5,031,720 | A | 7/1991 | Ohta et al. | |
| 5,357,586 | A | 10/1994 | Nordchow et al. | |
| 5,373,565 | A | 12/1994 | Watanabe | |
| 5,689,573 | A * | 11/1997 | Jones | H04R 1/22 381/337 |
| 5,721,786 | A | 2/1998 | Carrington | |
| 5,894,524 | A | 4/1999 | Kotsatos et al. | |

(Continued)

*Primary Examiner* — Khai N. Nguyen
*Assistant Examiner* — Sabrina Diaz
(74) *Attorney, Agent, or Firm* — Matthew G. McKinney, Esq.; Allen, Dyer, Doppelt + Gilchrist, PA

(57) ABSTRACT

A ported cavity tweeter includes a face plate having top and bottom surfaces, a diaphragm frame secured to the bottom surface of the face plate, and a central aperture passing through both the face plate and the diaphragm frame. In addition, the ported cavity tweeter includes a dome-shaped diaphragm positioned within the central aperture and having a periphery thereof secured to the diaphragm frame. A voice coil is wrapped on a voice coil former and mounted to the dome-shaped diaphragm. The ported cavity tweeter also includes a magnetic assembly having the diaphragm frame mounted thereon, and at least one acoustic duct extending through the face plate and diaphragm frame. The ported cavity tweeter is configured as a Helmholtz resonator to increase the output level over a range of frequencies.

20 Claims, 9 Drawing Sheets

(56) References Cited

U.S. PATENT DOCUMENTS

| | | | | |
|---|---|---|---|---|
| 6,457,548 | B1 | 10/2002 | D'Hoogh | |
| 7,463,744 | B2 | 12/2008 | Parker et al. | |
| 9,654,879 | B2 | 5/2017 | Jensen | |
| 2001/0043714 | A1 | 11/2001 | Asada et al. | |
| 2005/0117772 | A1 | 6/2005 | Chang | |
| 2006/0078153 | A1 | 4/2006 | Sato | |
| 2006/0182302 | A1 | 8/2006 | Onodera | |
| 2008/0025547 | A1 | 1/2008 | Yun et al. | |
| 2009/0304225 | A1 | 12/2009 | Kamimura et al. | |
| 2012/0281861 | A1 | 11/2012 | Lin | |
| 2015/0117698 | A1 | 4/2015 | Bullimore | |
| 2016/0127823 | A1 | 5/2016 | Huang et al. | |
| 2016/0165335 | A1* | 6/2016 | Goossens | H04R 31/00 381/351 |
| 2016/0173972 | A1 | 6/2016 | Moro | |
| 2017/0171663 | A1 | 6/2017 | Calmel et al. | |
| 2018/0070167 | A1* | 3/2018 | Kim | H04R 1/2803 |

* cited by examiner

PORTED CAVITY TWEETER

CROSS-REFERENCE TO RELATED APPLICATIONS

This application claims priority to U.S. Provisional Application Ser. No. 62/631,066 filed on Feb. 15, 2018 the contents of which are herein incorporated by reference in their entirety.

TECHNICAL FIELD

The present disclosure relates to the field of sound producing devices, and more particularly to a ported cavity tweeter.

BACKGROUND

Tweeters are a type of speaker that is designed to reproduce higher audio frequencies typically from as low as 1.5 kHz to 20 kHz or higher. As is known to those of skill in the art, the volume of air behind a tweeter diaphragm helps determine the frequency and Q factor at resonance, as the air acts as a spring against the diaphragm. For this reason, the volume of air behind the diaphragm of a traditional tweeter is sealed, to prevent the air from escaping during operation and deteriorating the sound quality of the speaker.

Although this arrangement has functioned well for many years, the small shape and size of tweeters have made it difficult for them to reproduce frequencies below around 3000 Hz at a high output level without excessive distortion or thermal overload. For example, a 25 mm diaphragm on a sealed tweeter would need to oscillate a distance of 0.24 mm in order to produce 100 dB SPL at 1 meter at 3000 Hz, but would need to increase this travel 4 fold to 0.96 mm at 1500 Hz. Most tweeters of this design use an underhung voice coil design in order to maximize efficiency, and will start to produce excessive distortion once exceeding around 0.2 mm travel, a travel distance that can be maintained by use of a tuned duct.

Due to this limitation, many commercial speaker systems employ a bass/midrange driver or a dedicated midrange driver to cover the frequencies up to 3000 Hz or higher. Unfortunately there are a lot of compromises with this approach such as cone breakup and reduced high frequency dispersion of the bass/midrange driver or a more complex and expensive crossover and box and the reduced efficiency of most dedicated midrange drivers.

SUMMARY

A ported cavity tweeter is disclosed. The ported cavity tweeter includes a face plate having top and bottom surfaces, a diaphragm frame secured to the bottom surface of the face plate, and a central aperture passing through both the face plate and the diaphragm frame. In addition, the ported cavity tweeter includes a dome-shaped diaphragm positioned within the central aperture and having a periphery thereof secured to the diaphragm frame. The ported cavity tweeter also includes a magnetic assembly having the diaphragm frame mounted thereon, and at least one acoustic duct extending through the face plate and the diaphragm frame. The ported cavity tweeter is configured as a Helmholtz resonator to increase an output level over a range of frequencies.

The dome-shaped diaphragm may comprise a woven fabric, thin metal or other such material. Further, the at least one acoustic duct may be orientated perpendicular to the top surface of the face plate, or in another aspect, at an angle relative to the top surface of the face plate.

The ported cavity tweeter may include a cavity of air formed under the dome-shaped diaphragm and the diaphragm frame, where the at least one acoustic duct forms an airway to connect ambient air to the cavity of air and is configured for a mass of air within the at least one acoustic duct to oscillate with movement of the dome-shaped diaphragm over a range of frequencies.

The ported cavity tweeter may also include a voice coil wrapped on a voice coil former and be mounted to the dome-shaped diaphragm. The voice coil former may have a plurality of apertures, and the magnet assembly may include a high energy magnet, and a voice coil gap for receiving the voice coil.

In a particular aspect, the at least one acoustic duct is sized and shaped to tune the cavity of air under the dome-shaped diaphragm to a desired particular frequency.

In another particular aspect, a method of making a ported cavity tweeter configured as a Helmholtz resonator to increase an output level over a range of frequencies includes providing a face plate having top and bottom surfaces. The method also includes securing a diaphragm frame to the bottom surface of the face plate, where a central aperture is defined through both the face plate and the diaphragm frame. The method includes positioning a dome-shaped diaphragm within the central aperture and securing a periphery thereof to the diaphragm frame. In addition, the method includes mounting the diaphragm frame to a magnetic assembly comprising a high energy magnet, and extending at least one acoustic duct through the face plate and diaphragm frame to form an airway connecting ambient air to a cavity of air under the dome-shaped diaphragm and the diaphragm frame, in order for a mass of air within the at least one acoustic duct to oscillate with movement of the dome-shaped diaphragm over a range of frequencies.

The method may also include securing a voice coil wrapped on a voice coil former to the dome-shaped diaphragm.

DETAILED DESCRIPTION

The present disclosure will now be described more fully hereinafter with reference to the accompanying drawings, in which several embodiments of the invention are shown. This present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like numbers refer to like elements throughout.

Figure 1:
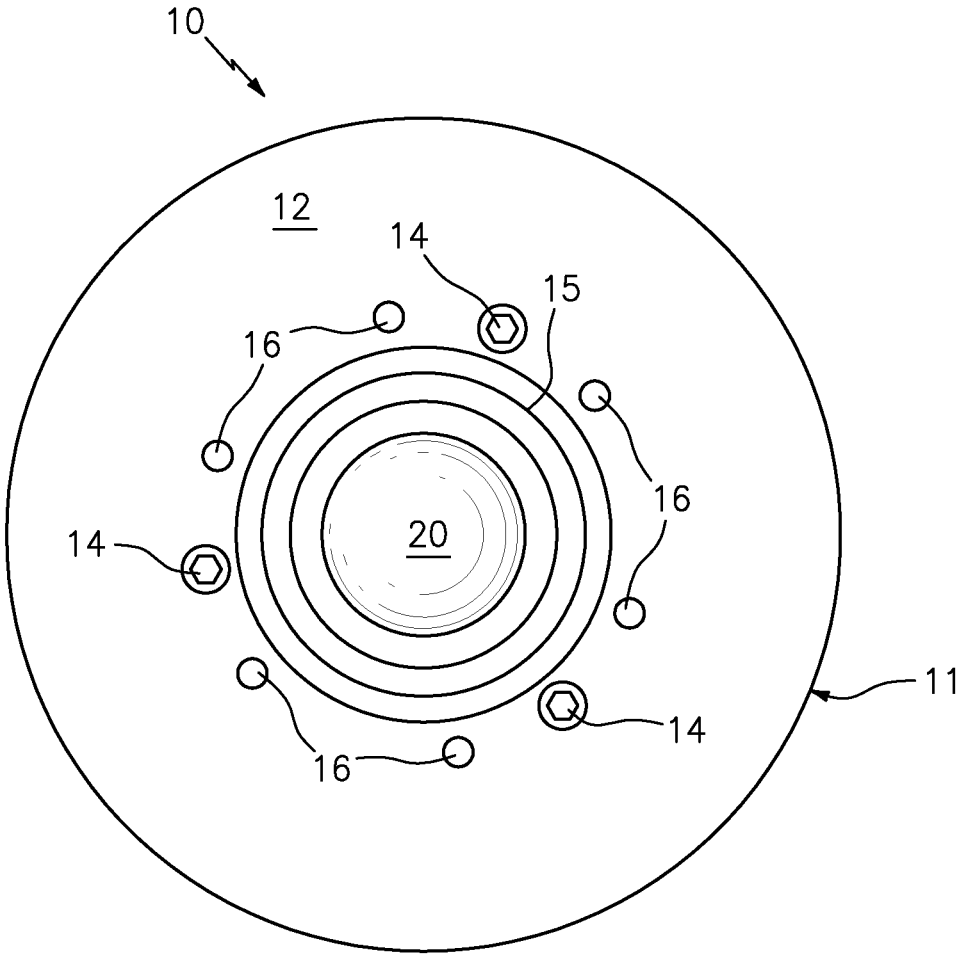
FIG. 1 is a top view of a ported cavity tweeter in accordance with the present disclosure.
Figure 2:
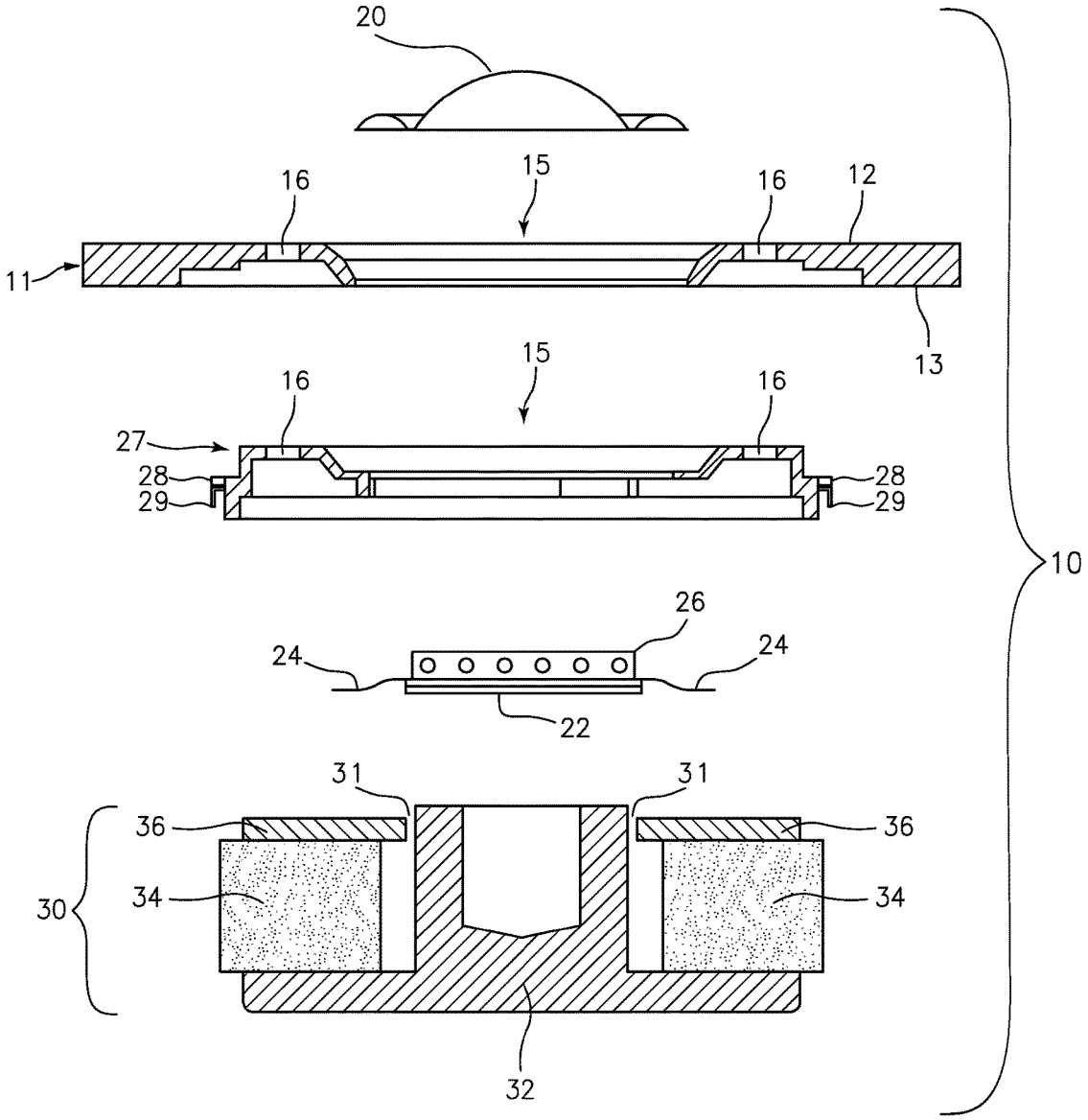
FIG. 2 is an exploded cross sectional view of the ported cavity tweeter of FIG. 1, in accordance with one aspect of the invention.

Referring initially to FIGS. 1 and 2, a top view and an exploded cross sectional view, respectively, of a ported cavity tweeter 10 (also referred to herein as "tweeter") in accordance with an aspect of the invention is illustrated. As explained in more detail below, the tweeter 10 is configured to connect a cavity of air behind a diaphragm 20 to the outside air through a plurality of acoustic ducts 16 that pass through the faceplate 11 and the diaphragm frame 27.

Accordingly, this novel configuration allows a mass of air within the acoustic ducts 16 to oscillate with the movement of the diaphragm 20 over a range of frequencies. As a result of the proximity of a first sound wave emitted from the diaphragm 20 and a second sound wave emitted from the acoustic ducts 16, the first and second sound waves interfere constructively over an octave or more.

The tweeter 10 serves as a Helmholtz resonator in order to increase an output level over a range of frequencies, and widens a useable frequency range when compared to a traditional sealed tweeter having the same shape and size. More specifically, the pressure waves produced by the oscillation of the air mass in the acoustic ducts 16 serve to dampen the movement of the diaphragm 20 causing the diaphragm 20 to move less over the tuned range of frequencies, which reduces the distortion of the tweeter 10 over this range.

Still referring to FIGS. 1 and 2, the tweeter 10 includes a face plate 11 that is generally a flat circular shape that and preferably constructed from plastic, or other non-magnetic material. The face plate 11 can include a top surface 12, a bottom surface 13, and a plurality of screws 14 that secure the face plate 11 to the magnet assembly 30. A central opening (aperture) 15 is provided for securing the diaphragm 20, and a plurality of acoustic ducts 16 are disposed about the periphery of the central opening 15. As will be described below, the acoustic ducts 16 each include a specific area and length which function to allow the mass of air contained within each acoustic duct 16 to oscillate in correlation with the diaphragm 20 over a range of frequencies during operation of the tweeter 10.

The dome-shaped diaphragm 20 may be constructed of woven fabric, thin metal or other such material. A voice coil 22 having a pair of leads 24 extending therefrom can be wrapped on a voice coil former 26. The voice coil 22 is preferably constructed from thin electrically conductive wire with an insulating coating, and the voice coil former 26 may be constructed from a low magnetic permeability material such as aluminum or polyimide, for example. The tweeter 10 also includes a diaphragm frame 27 that may have slots 28 for receiving a pair of voice coil terminals 29.

The tweeter 10 may also include a magnet assembly 30 having a bottom yoke with a pole piece 32 that is constructed from a high magnetic permeability material. The magnet assembly 30 also includes a high energy ring magnet 34 such as a neodymium or a ferrite magnet, for example, and a top plate 36 which may be also formed of a high magnetic permeability material. The pole piece and top plate are spaced to form a voice coil gap 31, where the voice coil is suspended.

Figure 3:
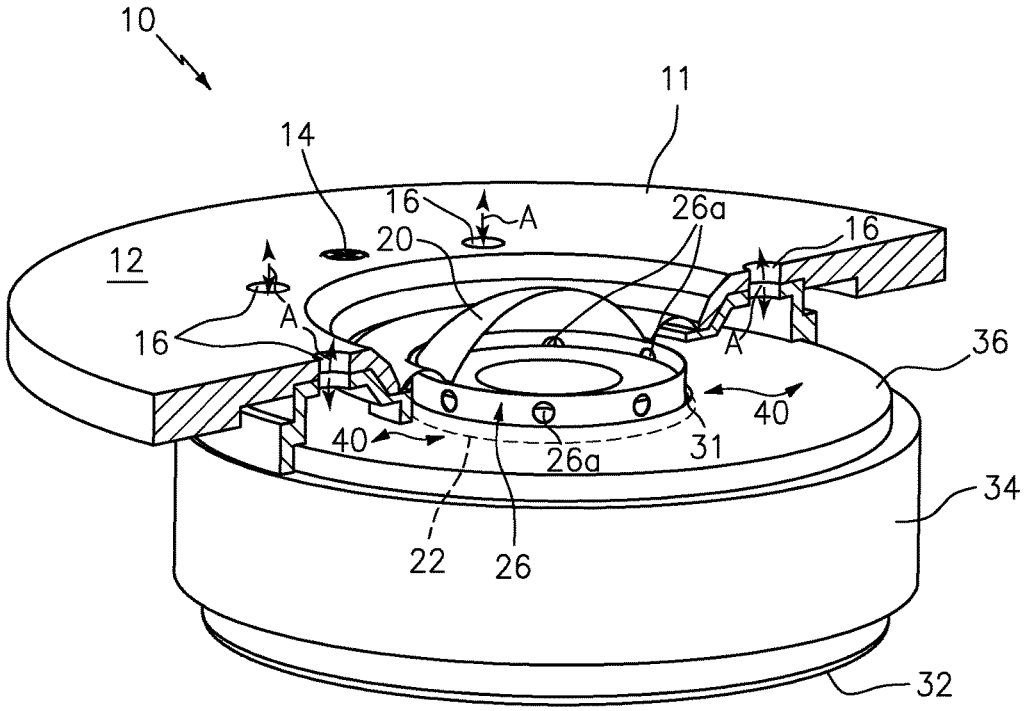
FIG. 3 is a partial cross sectional view of the ported cavity tweeter of FIG. 1.

FIG. 3 is a partial cross sectional view of the ported cavity tweeter 10 of FIGS. 1 and 2. In operation, current is applied to the voice coil 22 through the terminals 29, which causes the voice coil 22 to move relative to the magnet assembly 30 in a manner known in the art. The voice coil 22 moves with the voice coil former 26 and diaphragm 20 to produce the desired audio output. During this time, the air A within the cavity below the diaphragm 20 goes through compression and rarefaction. The pressure changes caused by the diaphragm 20 and its surround can travel through the voice coil former 26 via apertures 26*a*, across the top plate 36, through a gap 40 between the bottom surface of the diaphragm frame 27 and the top plate 36, to reach the air columns within the ducts 16.

Figure 4:
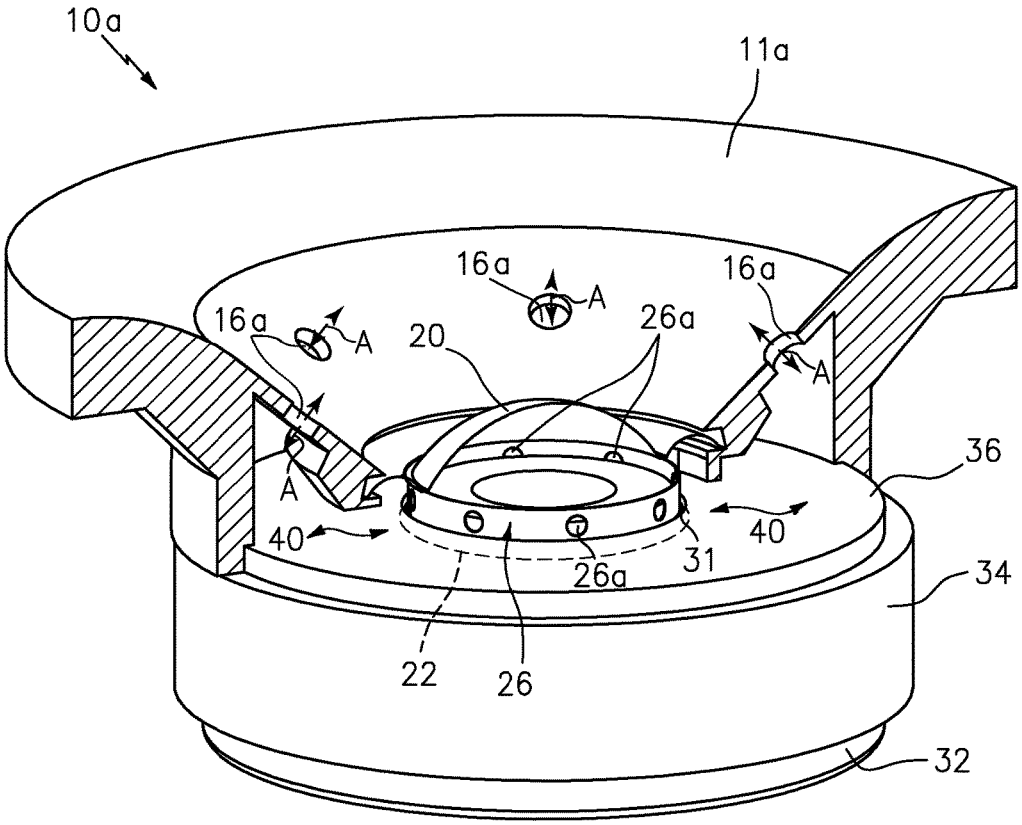
FIG. 4 is a partial cross sectional view of a ported cavity tweeter in accordance with another aspect of the invention.

FIG. 4 is a cross sectional view of a ported cavity tweeter 10*a* in accordance with an aspect of the invention having a plurality of acoustic ducts 16*a*. Here, the face plate 11*a* has been combined with the diaphragm frame 27, and extended forward to form a waveguide.

Figure 5A:
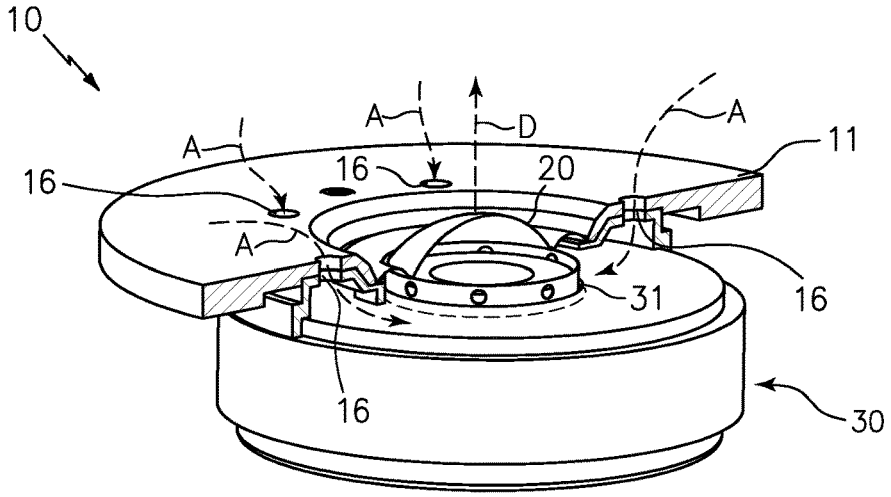
FIG. 5A is a partial cross sectional view of the ported cavity tweeter of FIG. 1 representing its operation below the tuning frequency.

Referring now to FIG. 5A, a cross sectional view of the tweeter 10 is shown illustrating the air movement well below the tuning frequency. As the diaphragm 20 moves up in the direction D, the air A within the cavity is coupled to the air mass within the acoustic ducts 16, acting as one unit and drawing air into the cavity through the acoustic ducts 16. At this point, the diaphragm 20 and duct air are out of phase, and the net result is a partial cancellation of the sound wave produced by the diaphragm 20, with an increase in diaphragm travel and distortion. As the frequency is increased, the inertia of the air column in the acoustic ducts 16 becomes too much for it to move as one with the cavity air, and they start to de-couple, with the air in the duct 16 being delayed from the diaphragm movement.

Figure 5B:
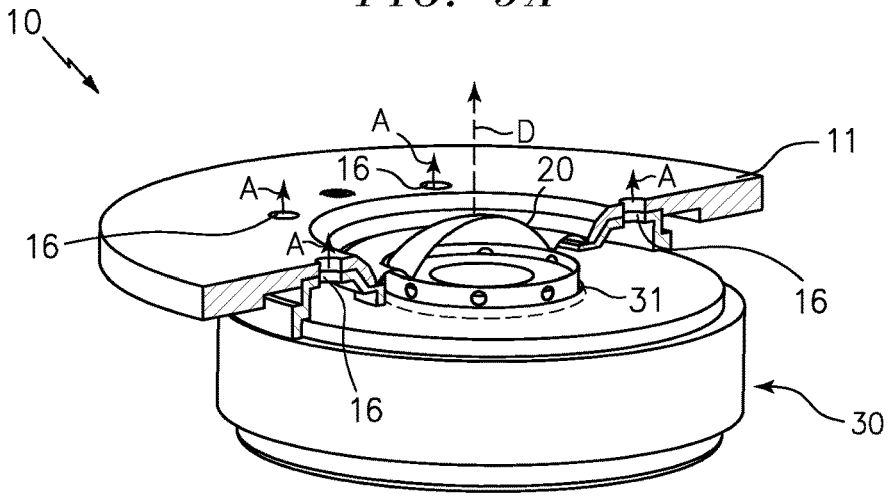
FIG. 5B is a perspective cut-away view of the ported cavity tweeter of FIG. 1 representing its operation at the tuning frequency.

FIG. 5B illustrates air movement at the tuning frequency. When the frequency reaches around ⅓ of an octave below the tuning frequency, the mass of air A within the acoustic ducts 16 starts to synchronize with the movement direction D of the diaphragm 20, increasing the total output. As the diaphragm 20 moves up, the inertia of the air column within the acoustic ducts 16 causes it to be delayed by one half cycle, thus now moving in phase with the diaphragm 20. At the tuning frequency, the column of air within the acoustic ducts 16 resonates with the air cavity, maximizing total output and minimizing the diaphragm travel.

Figure 5C:
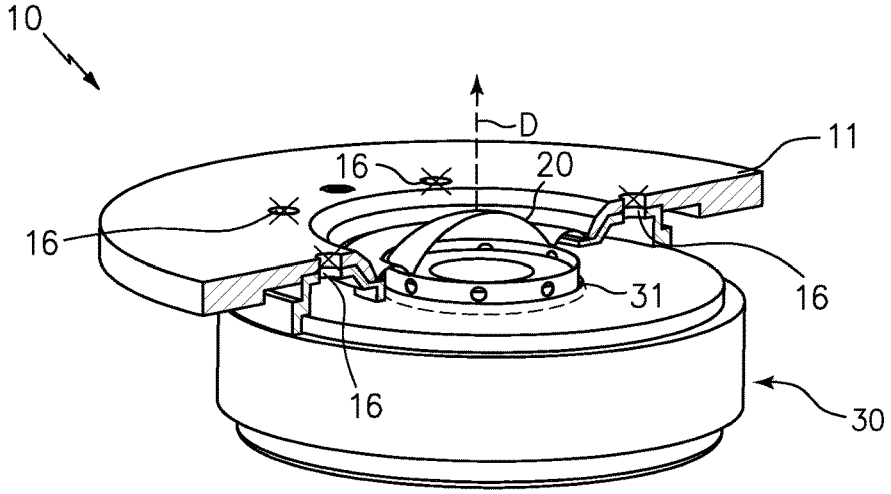
FIG. 5C is a perspective cut-away view of the ported cavity tweeter of FIG. 1 representing its operation above the tuning frequency.

FIG. 5C illustrates the air movement well above the tuning frequency. When the frequency reaches an octave or more above the tuning frequency, the inertia of the column of air within the acoustic ducts 16 becomes too great to move, as the pressure wave from the diaphragm 20 is dissipated within the cavity air. Thus the ducts 16 do not contribute to any output, and the cavity is effectively closed.

Figure 6:
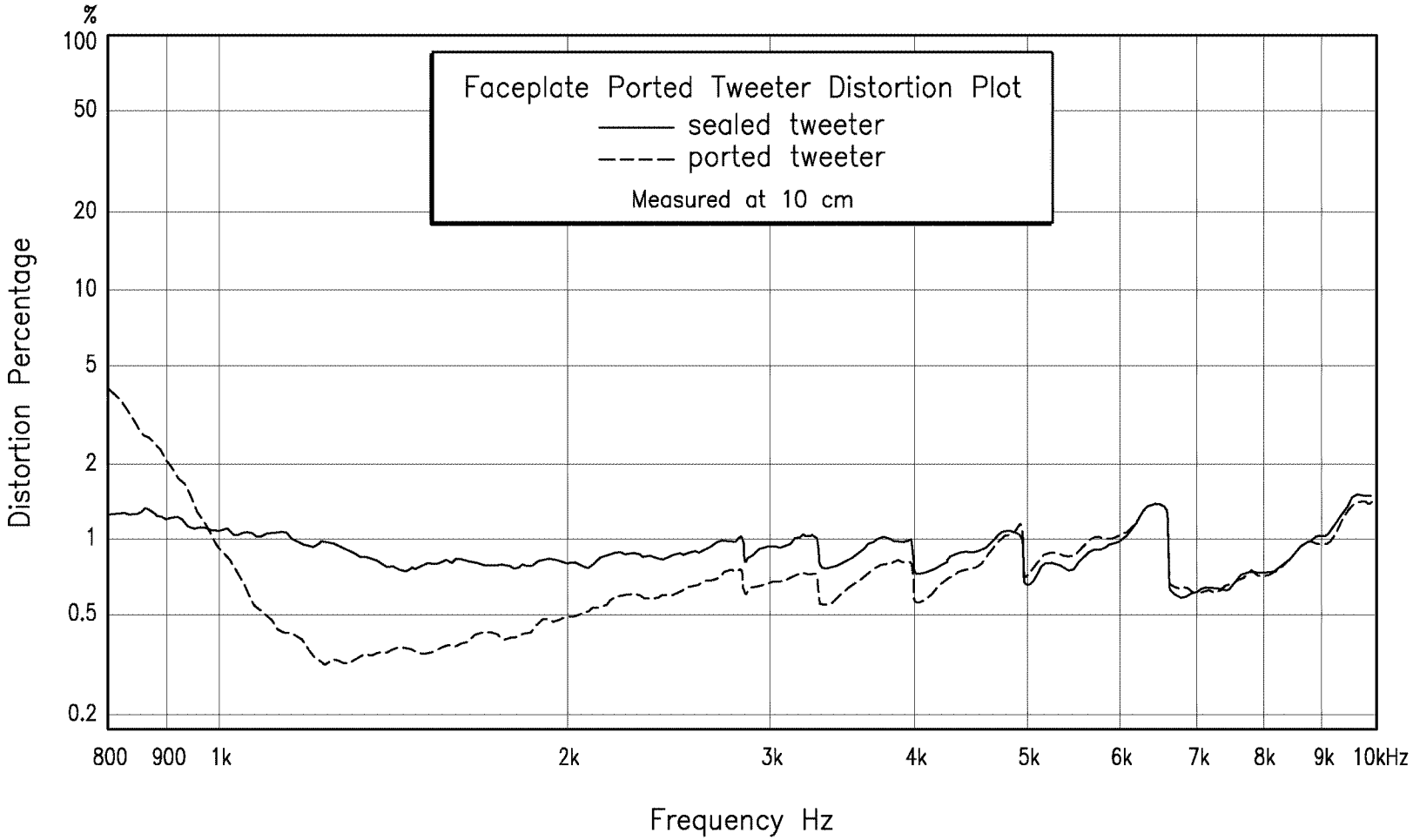
FIG. 6 is a comparative distortion response diagram of the ported cavity tweeter of FIG. 1.
Figure 7:
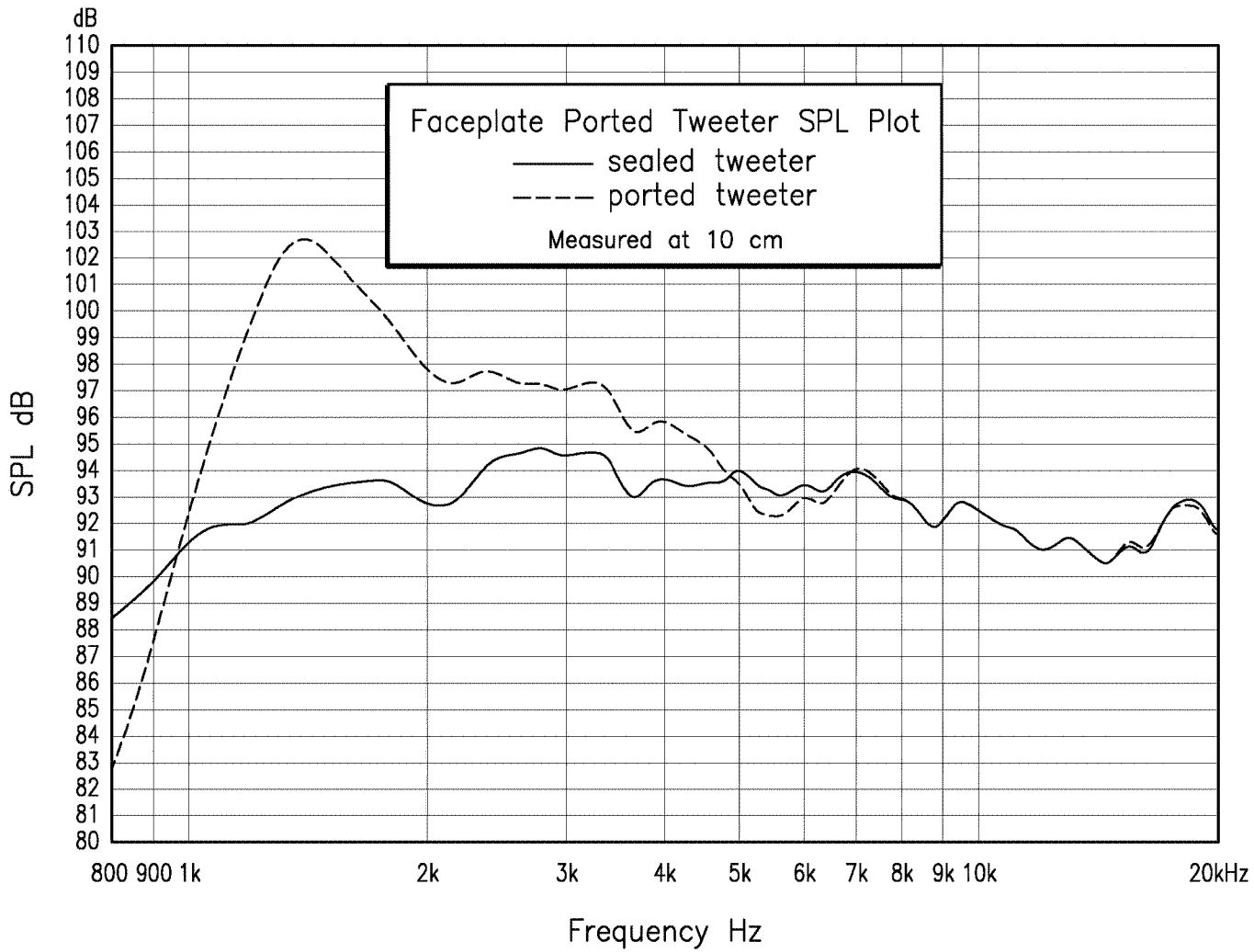
FIG. 7 is a comparative Sound Pressure Level (SPL) response diagram of the ported cavity tweeter of FIG. 1.

As evidenced by the test results shown in FIGS. 6 and 7, the tweeter 10 described above (identified as the "Faceplate Ported Tweeter" in the charts) achieves much better sound quality than other non-ported tweeters having identical shapes, sizes and at the same power levels.

For example, in FIG. 6 the relative distortion between about 1.0 k and 5.0 k Hz for the tweeter 10 is less than the sealed tweeter. Reviewing the same range of frequency in FIG. 7 between 1.0 k and 5.0 k Hz shows that the sound pressure level ("SPL") produced by the tweeter 10 is higher than that of the sealed tweeter.

To this end, the sound pressure wave produced by the oscillation of the air in the acoustic ducts 16 enhances the sound pressure wave produced by the diaphragm 20, thereby increasing the total sound pressure level across a range of tuned frequencies.

The increase in air pressure on the diaphragm 20 reduces the extent of its travel which lowers the distortion when the same power is applied to the tweeter 10 as reflected in FIG. 6. Also, the tweeter 10 is capable of more than 6 dB increase in output level across a range of tuned frequencies compared to a conventional non-ported tweeter as reflected in FIG. 7. Thus, tweeter 10 requires less than a quarter of the amplifier power to produce the same SPL as a non-ported tweeter across this range, while at the same time reducing the tweeter's distortion across these frequencies.

Figure 8:
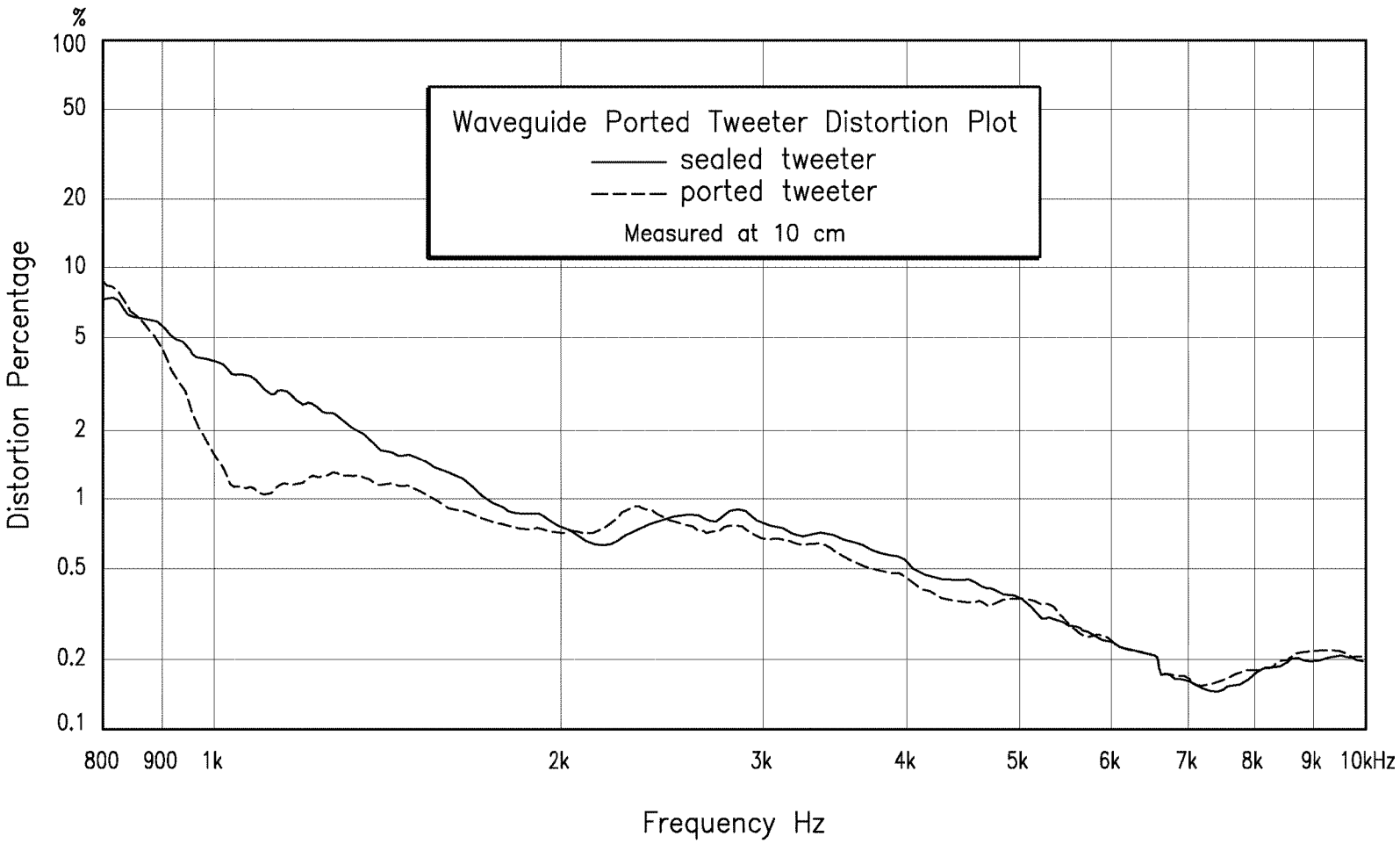
FIG. 8 is a comparative distortion response diagram of the ported cavity tweeter of FIG. 4.
Figure 9:
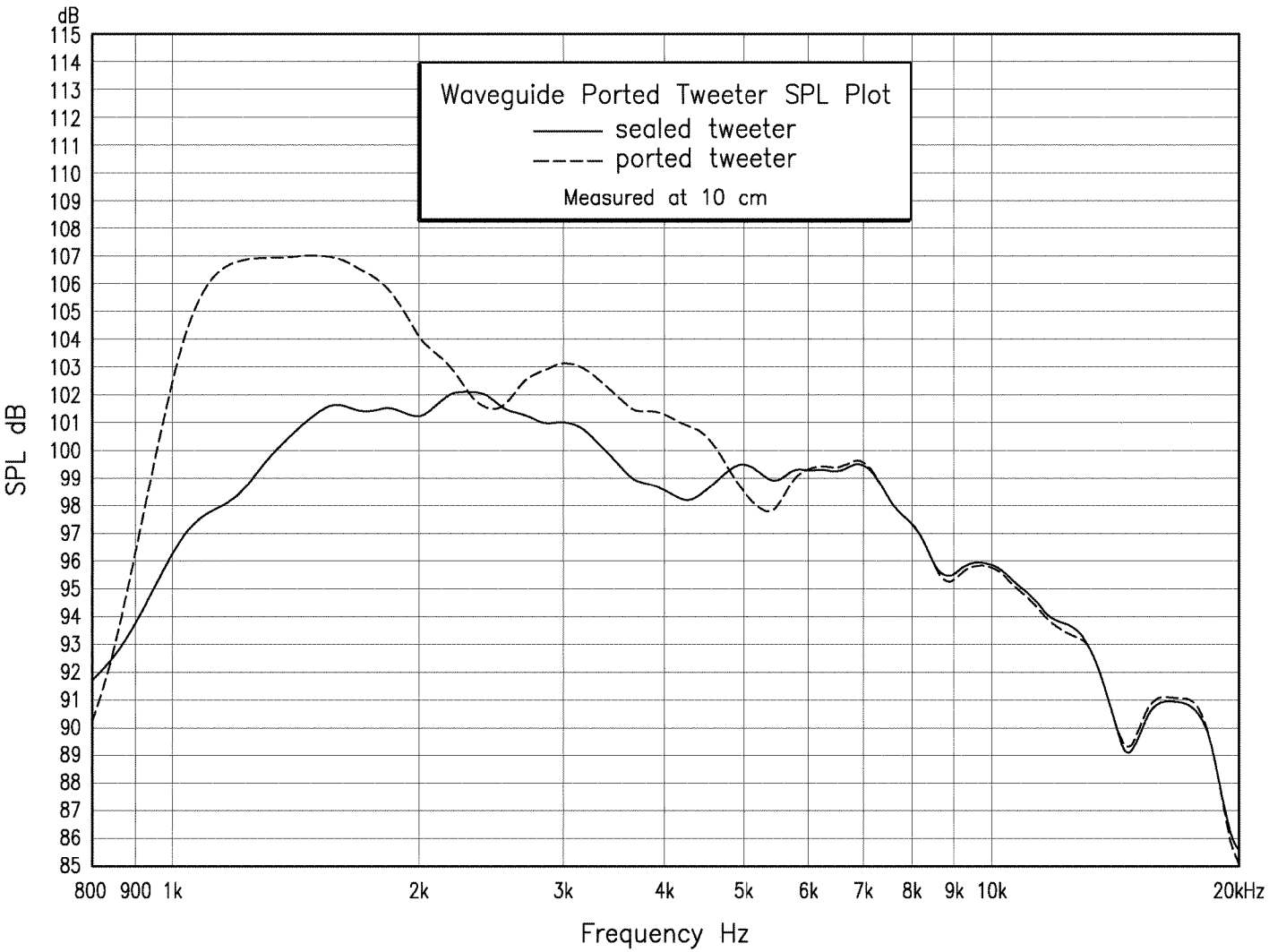
FIG. 9 is a comparative Sound Pressure Level (SPL) response diagram of the ported cavity tweeter of FIG. 4.

FIG. 8 illustrates another aspect of ported cavity tweeter 10*a* that includes the face plate 11*a* being extended forward to form a waveguide. Similar to the test results of the "Faceplate ported Tweeter" discussed above, the test results shown in FIGS. 8 and 9 for "Waveguide Ported Tweeter" 10*a* achieves significantly better sound quality than other non-ported tweeters having identical shapes, sizes and at the same power levels.

The relative distortion between about 1.0 k and 5.0 k Hz for the tweeter 10*a* is less than the sealed tweeter as shown in FIG. 8. Reviewing the same range of frequency in FIG. 9 between 1.0 k and 5.0 k Hz shows that the sound pressure level ("SPL") produced by the tweeter 10*a* is higher than that of the sealed tweeter.

As described herein, one or more elements of the ported cavity tweeter 10 (and 10*a*) may be secured together utilizing any number of known attachment means such as, for example, screws, glue, compression fittings and welds, among others. Moreover, although the above aspects of the invention have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

That which is claimed is:

1. A ported cavity tweeter comprising:

a face plate having top and bottom surfaces;

a diaphragm frame secured to the bottom surface of the face plate;

a central aperture passing through both the face plate and the diaphragm frame;

a dome-shaped diaphragm positioned within the central aperture and having a periphery thereof secured to the diaphragm frame;

a magnetic assembly having the diaphragm frame mounted thereon; and at least one acoustic duct extending through the face plate and diaphragm frame;

wherein the ported cavity tweeter is configured as a Helmholtz resonator to increase an output level over a range of frequencies.

2. The ported cavity tweeter of claim 1, wherein the dome-shaped diaphragm comprises a woven fabric, thin metal or any combination thereof.

3. The ported cavity tweeter of claim 1, wherein the at least one acoustic duct is orientated perpendicular to the top surface of the face plate.

4. The ported cavity tweeter of claim 1, wherein the at least one acoustic duct is orientated at an angle relative to the top surface of the face plate.

5. The ported cavity tweeter of claim 1, further comprising a cavity of air formed under the dome-shaped diaphragm.

6. The ported cavity tweeter of claim 5, wherein the at least one acoustic duct forms an airway to connect ambient air to the cavity of air and is configured for a mass of air within the at least one acoustic duct to oscillate with movement of the dome-shaped diaphragm over the range of frequencies.

7. The ported cavity tweeter of claim 6, wherein the magnetic assembly comprises a high energy magnet.

8. The ported cavity tweeter of claim 5, wherein the at least one acoustic duct is sized and shaped to tune the cavity of air under the dome-shaped diaphragm to a desired particular frequency.

9. The ported cavity tweeter of claim 1, further comprising a voice coil wrapped on a voice coil former and mounted to the dome-shaped diaphragm.

10. The ported cavity tweeter of claim 9, wherein the voice coil former has a plurality of apertures.

11. A ported cavity tweeter comprising:

a face plate having top and bottom surfaces;

a diaphragm frame secured to the bottom surface of the face plate;

a central aperture passing through both the face plate and the diaphragm frame;

a dome-shaped diaphragm positioned within the central aperture and having a periphery thereof secured to the diaphragm frame;

a magnetic assembly comprising a high energy magnet and having the diaphragm frame mounted thereon; and at least one acoustic duct extending through the face plate and diaphragm frame forming an airway to connect ambient air to a cavity of air and is configured for a mass of air within the at least one acoustic duct to oscillate with movement of the dome-shaped diaphragm over a range of frequencies;

wherein the ported cavity tweeter is configured as a Helmholtz resonator to increase an output level over the range of frequencies.

12. The ported cavity tweeter of claim 11, wherein the dome-shaped diaphragm comprises a woven fabric, thin metal or any combination thereof.

13. The ported cavity tweeter of claim 11, wherein the at least one acoustic duct is orientated perpendicular to the top surface of the face plate.

14. The ported cavity tweeter of claim 11, wherein the at least one acoustic duct is orientated at an angle relative to the top surface of the face plate.

15. The ported cavity tweeter of claim 11, wherein the cavity of air is formed under the dome-shaped diaphragm.

16. The ported cavity tweeter of claim 15, wherein the at least one acoustic duct is sized and shaped to tune the cavity of air under the dome-shaped diaphragm to a desired particular frequency.

17. The ported cavity tweeter of claim 11, further comprising a voice coil wrapped on a voice coil former and mounted to the dome-shaped diaphragm.

18. The ported cavity tweeter of claim 17, wherein the voice coil former has a plurality of apertures.

19. A method of making a ported cavity tweeter configured as a Helmholtz resonator to increase an output level over a range of frequencies, the method comprising:

providing a face plate having top and bottom surfaces;

securing a diaphragm frame to the bottom surface of the face plate, wherein a central aperture is defined through both the face plate and the diaphragm frame;

positioning a dome-shaped diaphragm within the central aperture and securing a periphery thereof to the diaphragm frame;

mounting the diaphragm frame to a magnetic assembly comprising a high energy magnet; and extending at least one acoustic duct through the face plate and diaphragm frame to form an airway connecting ambient air to a cavity of air under the dome-shaped diaphragm in order for a mass of air within the at least one acoustic duct to oscillate with movement of the dome-shaped diaphragm over the range of frequencies.

20. The method of claim 19, further comprising securing a voice coil wrapped on a voice coil former to the dome-shaped diaphragm.

* * * * *